US006152224A

United States Patent [19]

French

[11] Patent Number: 6,152,224

[45] Date of Patent: Nov. 28, 2000

[54] DOWNHOLE APPARATUS

[76] Inventor: Clive John French, 60 St. Swithin Street, Aberdeen AB1 6XJ, United Kingdom

[21] Appl. No.: 09/011,030

[22] PCT Filed: Aug. 5, 1996

[86] PCT No.: PCT/GB96/01907

§ 371 Date: Feb. 5, 1998

§ 102(e) Date: Feb. 5, 1998

[87] PCT Pub. No.: WO97/06344

PCT Pub. Date: Feb. 20, 1997

[30] Foreign Application Priority Data

Aug. 5, 1995 [GB] United Kingdom ..... 9516114
Feb. 3, 1996 [GB] United Kingdom ..... 9602211

[51] Int. Cl.[7] ..... E21B 47/00

[52] U.S. Cl. ..... 166/250.08; 166/130; 166/131; 166/141; 166/151; 166/250.17; 166/386; 166/387

[58] Field of Search ..... 166/250.08, 250.17, 166/383, 386, 387, 130, 131, 141, 151

[56] References Cited

U.S. PATENT DOCUMENTS

| | | | |
|---|---|---|---|
| 2,942,667 | 6/1960 | Blood et al. . | |
| 3,722,862 | 3/1973 | Dolce . | |
| 3,823,773 | 7/1974 | Nutter . | |
| 4,712,613 | 12/1987 | Nieuwstad | 166/53 |
| 4,817,723 | 4/1989 | Ringgenberg | 166/321 |
| 5,291,947 | 3/1994 | Stracke | 106/187 |
| 5,396,953 | 3/1995 | Holder et al. | 166/129 |

FOREIGN PATENT DOCUMENTS

| | | |
|---|---|---|
| 0 116 443 A1 | 8/1984 | European Pat. Off. . |
| 2272774 | 5/1994 | United Kingdom . |
| WO 97/05759 | 2/1997 | WIPO . |

*Primary Examiner*—Roger Schoeppel
*Attorney, Agent, or Firm*—Gifford, Krass, Groh, Sprinkle, Anderson & Citkowski, P.C.

[57] ABSTRACT

Apparatus for use in setting packers and other fluid actuated devices includes a tubular body (222), a valve (228) for controlling the flow of well fluid through a port (234) in the body (222) and a valve actuator (224) mounted on the body (222) and movable relative thereto, to open the valve (228) by application of well fluid pressure. The well fluid may flow through the open valve (228) to set a packer or actuate a device.

18 Claims, 9 Drawing Sheets

324
327
322
310
341
339
326
325
335
337
334
347
343
345
351
349
346
344

352
357
355
353

DOWNHOLE APPARATUS

This invention relates to apparatus for use in downhole operations. In particular, but not exclusively, the apparatus is intended for use in completion testing and in operations which take place immediately following completion testing.

In the oil and gas exploration and extraction industries, deep bores are drilled to gain access to hydrocarbon-bearing strata. The section of bore which intersects this strata or "production zone" is typically provided with a steel "liner", while the section of bore extending to the surface is lined with steel "casing". Oil and gas is extracted from the production zone through production tubing extending through the casing from the upper end of the liner. The production tubing is formed of a string of threaded sections or "subs" which are fed downwards from the surface, additional subs being added at the surface until the string is of the desired length. As the string is assembled and fed into the bore its pressure integrity, or "completion", is tested at regular intervals. Such testing is also carried out on the complete string. The testing is accomplished by pressurising the internal bore of the string. Of course this requires that the string bore is sealed at its lower end. However, it is desirable that the string fills with well fluid as it is lowered into the bore. The applicant has previously developed a tool to accommodate these conflicting requirements, as described in GB-A-2 272 774. The tool includes a sleeve mounted on a tubular body which forms part of the string. A port is provided in the body and is normally aligned with a port in the sleeve to permit well fluid to flow, from the annulus, into the string. However, on pressurising the string bore, by pumping fluid down the bore from the surface, the resulting pressure force acts on a piston defined by the sleeve to move the sleeve and seal the body port. The completion of the string may then be tested. On the pressure being bled off, a spring returns the sleeve to the initial position and opens the ports.

A string may carry a number of fluid pressure actuated tools or fittings, including packers for locating or sealing a production string within a casing. Valves or plugs may also be provided on the lower end of the tubing and may be opened or removed once the packers have been set, to permit formation testing and also to permit formation fluid to flow upwardly to the surface through the production tubing. Typically, packers are mounted on the exterior of the string and are inflated or otherwise set, when the packer is in the desired location, to engage the casing. However, during completion testing any packers mounted on the string may be prematurely set by the application of the elevated completion testing pressures. Clearly this is not desirable, and may create difficulties as the string is moved downwardly and further into the bore. Further, the opening or removal of valves or plugs following setting of the packers may require running in of an appropriate tool on wireline or coiled tubing, which will involve additional time and expense.

It is among the objects of aspects of the present invention to obviate or mitigate one or more of these disadvantages.

According to the present invention there is provided downhole apparatus comprising: a tubular body; a valve for controlling the flow of well fluid through a first port in the tubular body, the port being in communication with a fluid pressure actuated device; and a valve actuator mounted on the body and moveable relative thereto, to open the valve, by application of well fluid pressure.

According to another aspect of the present invention there is provided a method of selectively actuating a pressure actuated downhole tool, the method comprising: providing a valve for controlling flow of well fluid through a port in a tubular body, the port being in communication with a fluid pressure actuated device; providing a valve actuator on the tubular body; applying well fluid pressure to the actuator to open the valve and permit communication of said fluid pressure to said device.

The invention thus provides a means for controlling actuation of fluid pressure actuated tools by well fluid pressurisation, thus obviating the requirement to provide control lines from the surface to the tools. The tools may thus be located below packers and in other relatively inaccessible locations.

Preferably, the actuator is movable in response to fluid pressure increases and decreases within the tubular body. Typically, in use, the medium providing the fluid pressure will be fluid or "mud" being pumped into a tubing string from the surface. Most preferably, the actuator includes a member in the form of an axially slidable sleeve. The sleeve may be biassed towards a first position by spring means. In the preferred embodiment, the sleeve defines a piston in fluid communication with the body bore, whereby an increase in bore pressure is communicated to the piston and tends to move the piston towards a second position.

Preferably also, the actuator includes a ratchet assembly having a member which advances one step relative to the body towards a respective actuating position with each pressure cycle. Most preferably, the ratchet assembly is provided between the body and the sleeve and an actuating member is advanced axially along the body. In the preferred embodiment the actuating member is located between respective ratchet tracks defined by the sleeve and body.

The actuator sleeve may itself be a valve member and define a port for providing communication with a further port in the body, to permit passage of fluid between the interior of the body and the annulus defined between the body and the bore wall. The apparatus may thus be utilised, in a first configuration, for completion testing in a similar manner to that described in GB-A-2 272 774, and may then be utilised in a second configuration to open one or more valves for, for example, selective setting of packers or to open full flow ports in the string. The actuator sleeve may be initially positioned on the body to permit fluid communication through said further body port, application of fluid pressure to the actuator moving the sleeve to a second position to close the port, means being provided for biasing the sleeve to return to the initial position. In one embodiment, means is provided for restricting return movement of the sleeve from the second position such that the further body port remains closed after a predetermined number of pressure cycles.

The apparatus may include two or more valves for selectively controlling fluid communication to a plurality of respective tools and the like.

The valve may be in the form of a shuttle valve, or may include a valve sleeve or other valve member defining at least one port which may be aligned with the body port to permit fluid communication therethrough; in a first position the valve member closes the body port and is movable to a second position to allow flow through the body port. In a preferred embodiment, the valve member is movable beyond the second position to a third position to close the body port once more.

The apparatus may be provided in combination with one or more packers or with a flow sleeve. The flow sleeve may be opened, following completion testing and setting of the packers, to allow fluid to flow between the lower end of the string and the annulus. The flow sleeve may comprise a tubular body with a port in the body wall, and an aperture sleeve mounted on the body, the body port initially being closed by the sleeve. A pressure port provides fluid communication between the valve and a piston face defined by the sleeve, and on opening the valve the fluid in the body bore may apply a pressure force to the sleeve and move the sleeve to a second position and open the body port. The sleeve may be retained in an initial position by releasable means, such as shear pins, and may be retained in the second position by a latch or ratchet. Biassing means, such as a spring, may also be provided to assist in moving the sleeve to the second position. The end of the flow sleeve body is initially closed, preferably by a removable plug. Thus, when it is desired to fully open the lower end of the string, the plug may be removed using, for example, wireline or coiled tubing provided with an appropriate fishing tool.

According to another aspect of the present invention there is provided downhole apparatus comprising first and second parts initially reciprocally movable between first and second relative positions and wherein it is desired subsequently to restrict the relative reciprocal movement of the parts, the apparatus further comprising a connecting member being movable with the second part with each movement of the second part in one direction and being retained by the first part with each subsequent movement of the second member in the opposite direction such that the connecting member position is advanced relative to the first part with each cycle, in a selected one or more of its positions the connecting member supporting a portion of the first part to engage with a portion of second member to restrict the relative movement between the first and second parts.

The connecting member may initially be positioned relative to the first member to permit movement between the first and second positions and restrict said movement on reaching a selected advanced position. Thus, a full degree of movement may be available for a predetermined number of cycles and then only a restricted movement being available for subsequent cycles.

In a preferred embodiment the apparatus incorporates a valve which is open when the parts are in their first relative positions but is closed when the parts move to their second relative positions; initially the connecting member permits the valve to be closed and opened, but in its advanced position the connecting member prevents the valve from opening. Such an apparatus may be utilised as a completion testing tool, for permitting selective fluid communication between the tubing and annulus.

Preferably also, a ratchet link is provided for advancing the connecting member, and the first and second parts define respective ratchet teeth, a ratch moving with the second part in said one direction and being held relative to the first part when the second part moves in said opposite direction.

Preferably also, said portion of the first part includes a radially movable element and said portion of the second part includes a shoulder, the connecting member being located below the movable element and defining a recessed surface which, in selected positions of the connecting member, permits retraction of the movable element to clear the shoulder. The movable element may be in the form of a spring finger, but is preferably in the form of a key located in a aperture in a portion of the first part.

This aspect of the invention may be combined with embodiments of the first aspect of the invention described above.

These and other aspects of the present invention will now be described, by way of example, with reference to the accompanying drawings, in which.

Figure 1:
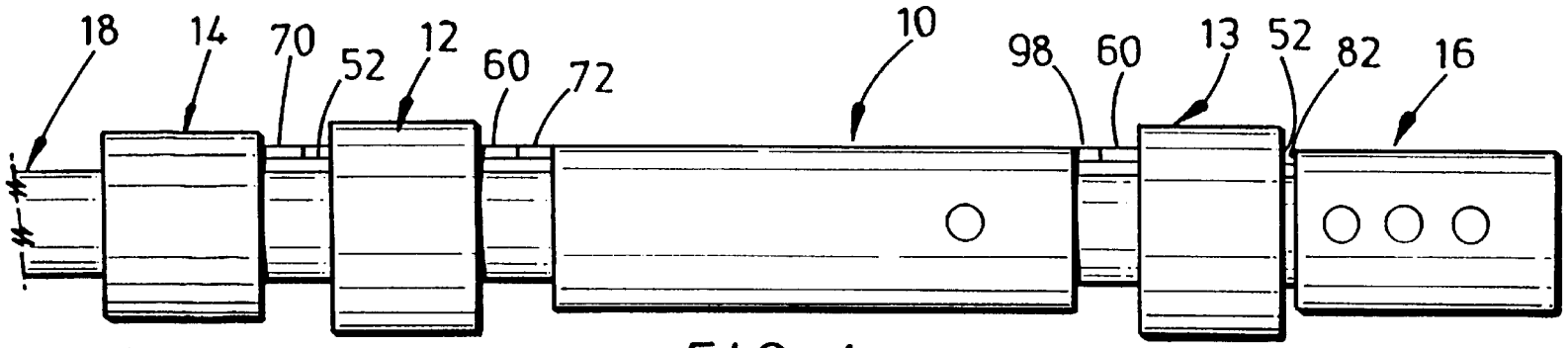
FIG. 1 is a somewhat schematic view of downhole apparatus in accordance with a first embodiment of the present invention, including a completion testing tool, two centralisers, a packer, and a full flow sleeve mounted on the end of a string.

Reference is first made to FIG. 1 of the drawings which illustrates downhole apparatus in accordance with a first embodiment of the present invention. The apparatus includes a completion testing tool 10, two centralisers 12,13, a packer 14, and a full flow sleeve 16. In this example, the apparatus 10 is mounted on the lower end of a tubular production string 18. As will be described, the completion test tool 10 is utilised as the string is extended into a bore lined with casing. At intervals the pressure integrity or "completion" of the string is tested using the tool 10. Once the string 18 has been made up to its full length and has been fully tested, the tool 10 is configured to allow setting of the packer 14. Following setting of the packer 14, the tool 10 is re-configured to allow opening of the sleeve 16.

Figure 2:
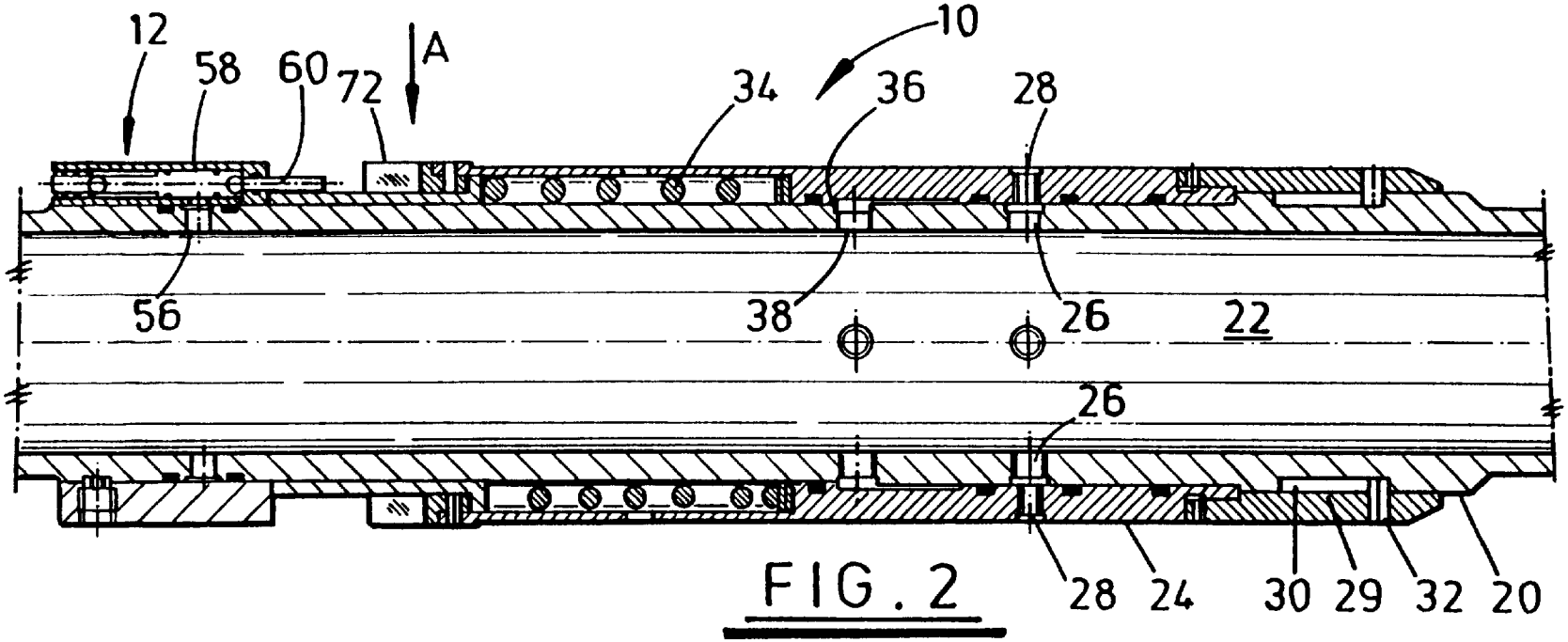
FIG. 2 is an enlarged sectional view of the completion testing tool and a centraliser of FIG. 1.

Reference is now made to FIG. 2 of the drawings which illustrates, in somewhat schematic fashion, the completion test tool 10 and the upper centraliser 12. The tool comprises a tubular body 20 defining a bore 22 which forms a continuation of the string bore. Mounted on the body 20 is an actuator in the form of a sleeve 24.

Figure 3:
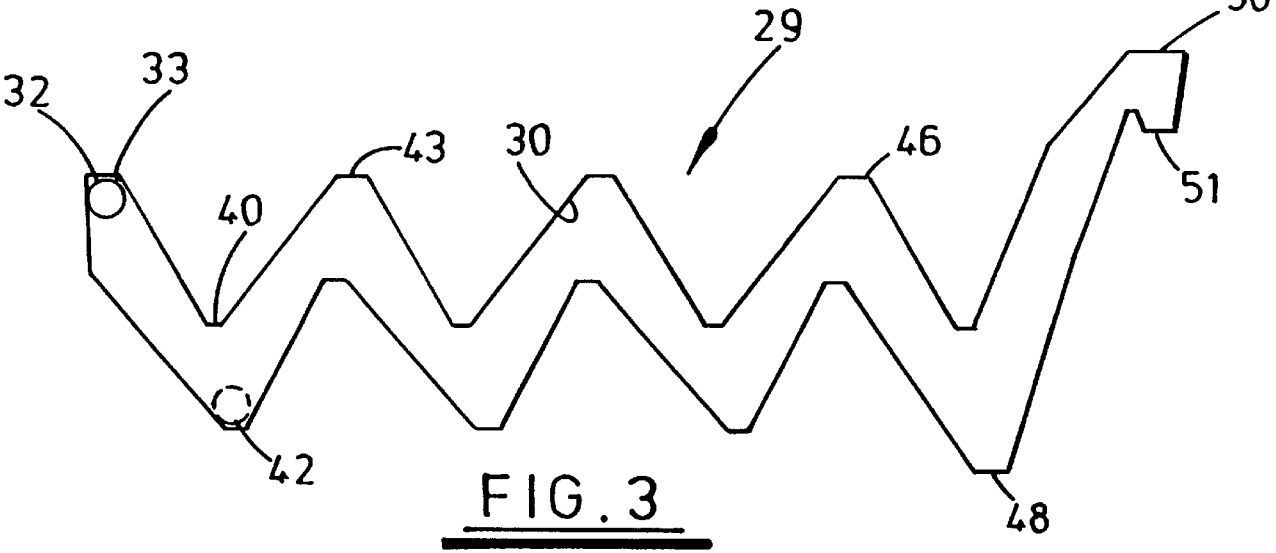
FIG. 3 is a representation of the ratchet profile of the completion testing tool of FIG. 2.

Both the body 20 and the sleeve 24 define flow ports 26,28 which are normally aligned to allow fluid to flow from the annulus between the sleeve 24 and the bore casing into the bore 22. Appropriate O-rings or S-seals are provided above and below the ports. Movement of the sleeve 24 relative to the body 22 is controlled by a ratchet 29 including a profile 30 (see FIG. 3) defined on an inner face of the body 20 and a follower 32 extending from the sleeve 24. Both FIGS. 2 and 3 illustrate the follower 32 in an initial position engaging a first stop 33. This initial position, with the ports 26,28 aligned, is maintained by a spring 34 which biases the sleeve 24 downwardly relative to the body 20.

As the string 18 is run-in, the aligned ports 26,28 allow well fluid to flow into the string bore. However, when it is desired to test the completion of the string, mud pumps at the surface are started and pump fluid into the bore. The pumped flow of fluid cannot be accommodated by the aligned ports 26,28 such that the fluid pressure within the bore rises. This pressure acts upon an annular piston 36 defined on an inner face of the sleeve 24 and in communication with the bore 22 via piston ports 38. Thus, the sleeve 24 is pushed upwardly relative to the body 20. This relative movement results in the ports 26,28 becoming misaligned such that the body ports 26 are blanked off by the sleeve 24. The string bore is now sealed, and by monitoring the fluid pressure in the bore at the surface, the completion of the string may be confirmed. The position of the follower 32 on the profile 30 at this point, engaging the second stop 42, is shown in FIG. 3.

Bleeding off pressure from the bore allows the spring 34 to move the sleeve downwardly once more though, due to the offset of the profile peak 40 from the stop 42, the follower 32 does not return to the stop 33 and the sleeve 24 is forced to rotate on the body 20 as it returns to its initial longitudinal position, with the follower 32 engaging a stop 43 aligned with the first stop 33. Of course, this requires that ports 26,28 are provided around the circumference of one or both of the body 20 and sleeve 24 to ensure that there are ports 26,28 in alignment after rotation of the sleeve 24 on the body 20.

The profile illustrated in FIG. 3 provides for the completion of the string to be tested on up to three separate occasions, though of course the profile could be configured to provide a smaller or greater number of testing opportunities. Typically, two completion tests are carried out, with a "spare" test position being available if necessary. In other cases additional "spare" test positions may be provided. However, on pressurising the string bore for a fourth time, the follower moves from the stop 46, aligned with the stop 33 and 43, to an opposing stop 48 which permits a greater degree of relative longitudinal movement between the sleeve 24 and the body 20 than the stop 42, allowing the sleeve 24 to move to a second longitudinal position. As will be described, this re-configuring of the sleeve 24 on the body 20 allows opening of a valve provided in the centraliser 12, to allow setting of the packer 14. On bleeding pressure off from the bore, the follower 32 travels to a further stop 50 which allows for a greater degree of downward movement of the sleeve 24 on the body 20 than provided by the stops 33,43,46. In this further configuration the sleeve 24 is used to open a valve provided in the centraliser 13 to allow opening of the sleeve 16, as will be described.

Figure 5:
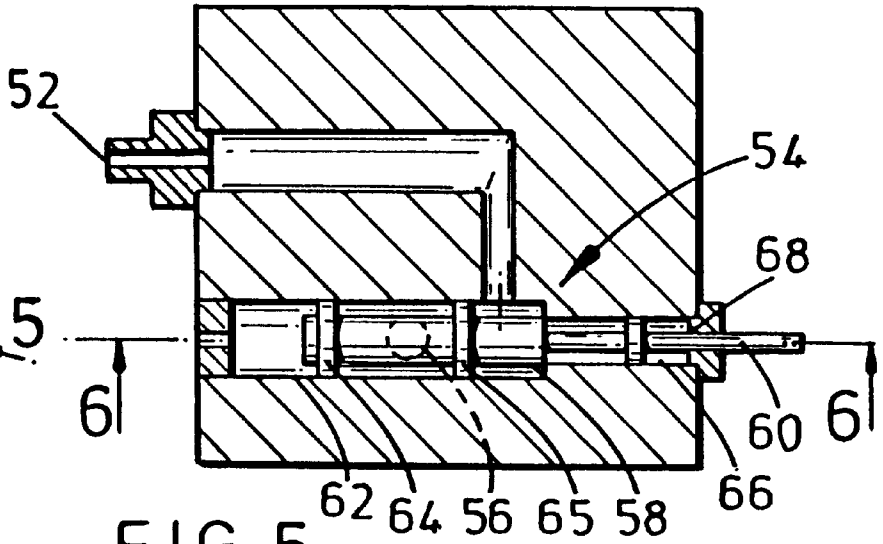
FIG. 5 is a sectional view on line 5—5 of FIG. 4, illustrating a valve arrangement.
Figure 6:
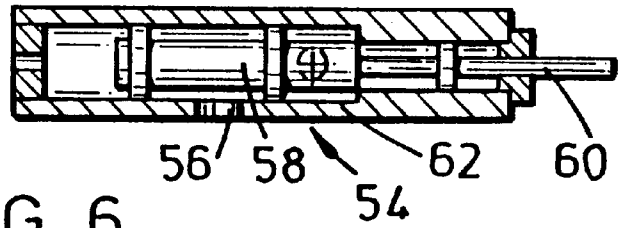
FIG. 6 is a sectional view on line 6—6 of FIG. 5, illustrating the valve arrangement.
Figure 4:
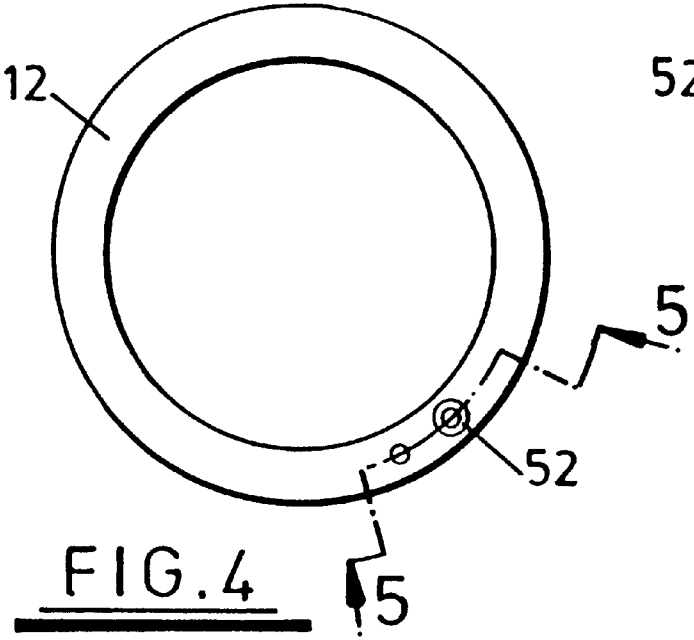
FIG. 4 is an end view of a centraliser of FIG. 1.
Figure 7:
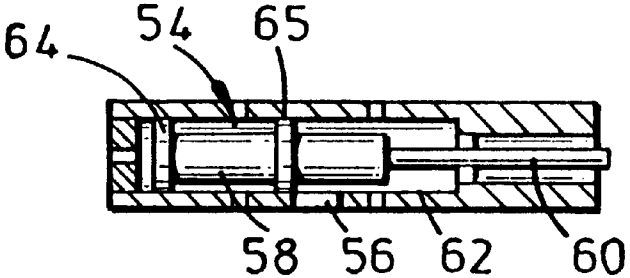
FIG. 7 is a sectional view of the valve arrangement of FIG. 5, showing the valve arrangement in the open position.

Reference is now also made to FIG. 4 of the drawings which is an end view of the centraliser 12 and shows a pressure port 52 which provides selective fluid communication, via a valve arrangement 54, as shown in FIG. 2 and as illustrated in FIGS. 5, 6 and 7 of the drawings, with a port 56 in communication with the string bore.

The valve arrangement 54 includes a cylindrical body 58 and a plunger or rod 60 extending from one end of the body 58, both being located within a longitudinally extending valve chamber 62 defined by the centraliser 12. The body 58 carries two spaced seals 64,65 which, with the valve closed, isolate the string bore communicating port 56 from the pressure port 52. The free end of the rod extends from the open lower end of the chamber 62. The body and rod 58,60 are initially restrained against movement by a shear out circlip 68 mounted on the end of the rod 60 extending from the chamber 62 and abutting the centraliser lower face.

Figure 2A:
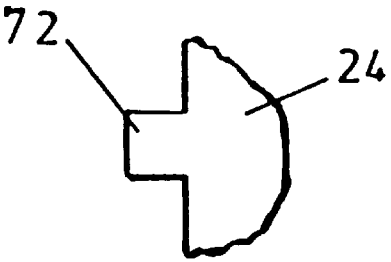
FIG. 2A is a scrap view on arrow A of FIG. 2.

The pressure port 52 is connected to a fluid line 70 (FIG. 1) which leads to the packer 14. To set the packer 14, the valve 54 is opened allowing pressurised fluid from the bore to flow in through the port 56, through the valve arrangement 54, and then from the pressure port 52 into the packer 14. The valve 54 is opened by an actuation dog 72 on the upper end of the sleeve 24 (see FIGS. 2 and 2A) pushing the rod 60 upwardly. However, the dog 72 only contacts the end of the rod 60 as the sleeve 24 is lifted relative to the body 20 and the follower 32 contacts the profile stop 48 which, as noted above, permits a greater degree of upward movement of the sleeve 24 than the earlier stops 42. Thus, the sleeve 24 only moves sufficiently to contact the rod 60 on its fourth pressure cycle, and typically after two completion testing operations and a further pressure cycle.

On the packer being correctly set, a hydraulic piston or other moving part within the packer 14 reaches the end of its travel and contacts a transmitter switch, causing a transmitter on the packer 14 to transmit a signal, typically a "ping", which may be detected at the surface. This informs the operator that the packer has been set. Where a number of packers are provided, each may include a transmitter which transmits a different frequency signal, allowing the operator to determine which packers have been set.

Figure 8:
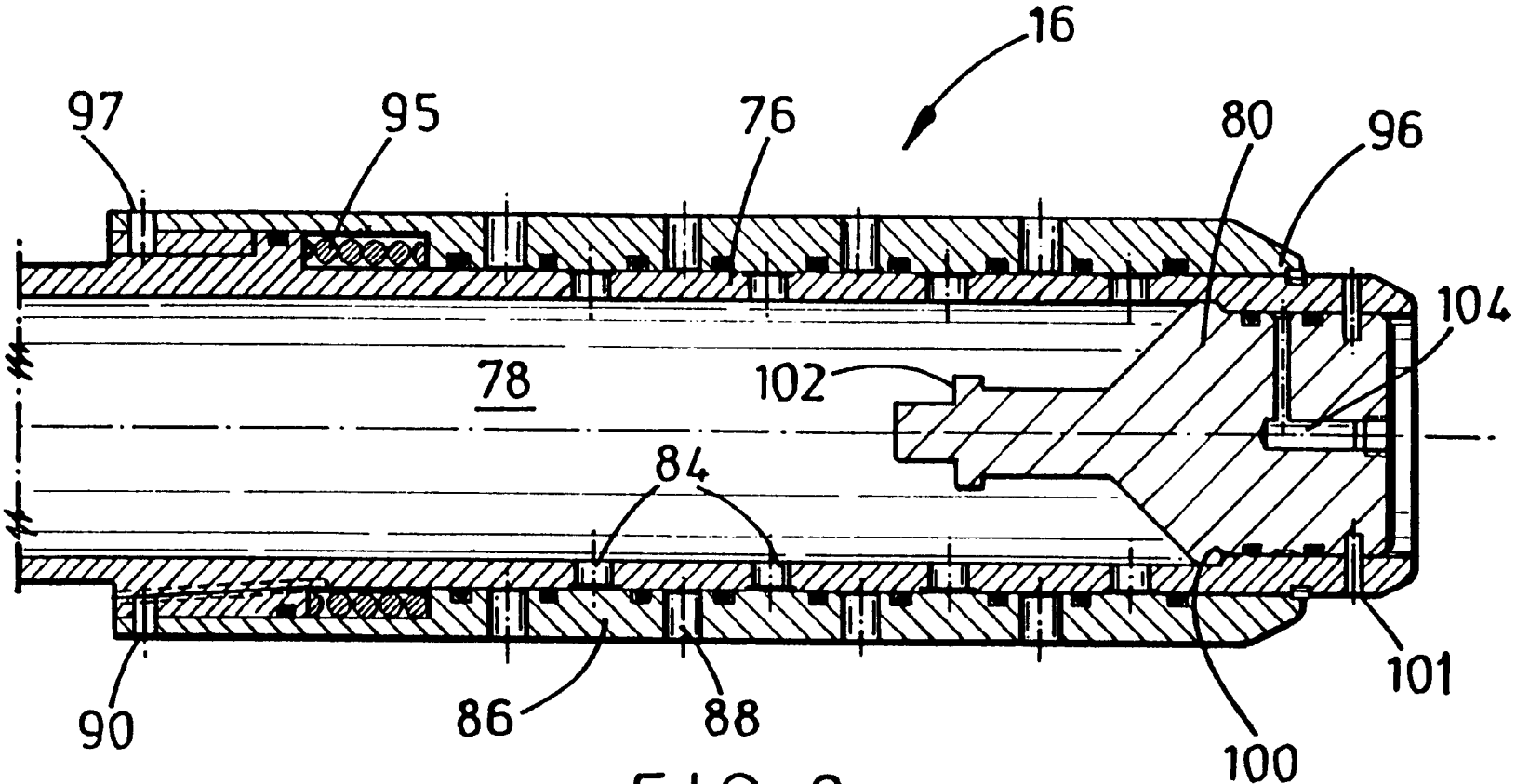
FIG. 8 is a somewhat enlarged sectional view of the full flow sleeve of FIG. 1.

The lower centraliser 13 is similar to the upper centraliser 12 described above and may be configured to allow fluid from the string bore to flow into and actuate the full flow sleeve 16, as will now be described with reference to FIG. 8 of the drawings. The sleeve 16 has a body 76 forming the lower end of the string and defining a through bore 78, though initially the lower end of the bore 78 is sealed by a removable plug 80. The body wall defines a number of ports 84 which are initially blanked off by a sleeve 86, movably mounted over the body 76. The sleeve defines a number of ports 88 which, as will be described, may be aligned with the body ports 84 to allow flow of fluid between the string bore and the annulus. Appropriate O-rings or S-seals are provided above and below the ports 88.

The sleeve 86 is biased towards the position in which the ports 84,88 are aligned by a spring 95, but is initially held on the body by shear pins 90 such that the ports are mis-aligned. To move the sleeve 86 and align the ports 84,88, pressure is applied through pressure port 82, which communicates with the pressure port 52 of the centraliser 13. The pressure force exerted by the fluid acts on an annular piston 94 defining the lower wall of a spring chamber in the sleeve 86, to shear the pins 90, and allowing the spring 95 to push the sleeve 86 downwardly relative to the body 76. A latch arrangement 96 is provided between the body 76 and the sleeve 86 to prevent retraction of the sleeve 86 once the ports 84,88 have been aligned, and a guide pin 97 ensures proper alignment of the sleeve 86 on the body 76.

The valve in the centraliser 13, which allows fluid to flow from the string bore into the port 92, is actuated by a dog 98 on the lower end of the sleeve 24 (see FIG. 1). The dog 98 contacts the centraliser valve rod 60 only when the follower 32 moves towards the stop 50 of the profile 30 (see FIG. 3), which permits a greater degree of downward movement of the sleeve 24 than the earlier stops 33,43,46.

This additional movement of the sleeve 24 closes the ports 26,28 and the piston ports 38, to allow the string bore to be pressurised. Also, the position of the next stop 51 on the profile 30 prevents subsequent upward movement of the sleeve 24 to the extent necessary to realign the bores 26,28, and thus effectively latches the sleeve 24 in the closed position.

The plug 80 may remain in place until it is necessary to provide unrestricted passage through the string bore. The plug 80 is supported against downward movement by a bore restriction 100, to prevent the plug 80 being pushed from the body 76 by completion testing pressures within the bore, and shear pins 101 prevent upward movement. The plug defines a test port 104. To remove the plug 80 from the bore 78 it is simply necessary to lower a suitable fishing tool on coiled tubing to engage the plug fishing neck 102 and then pull upwardly to shear the pins 101. The plug 80 may thus be withdrawn from the bore 78.

Reference is now made to FIG. 9 of the drawings, which illustrates apparatus in accordance with a preferred embodiment of the present invention. The apparatus 200 is shown located towards the lower end of a borehole and is mounted on the lower end of a tubing test string 202 made up of a number of threaded tubular lengths. The borehole is lined with casing 204 and at the lower end of the borehole, which intersects an oil bearing formation, a liner 206 is provided and is mounted relative to the casing 204 by a liner seal 208. In this embodiment the apparatus 200 comprises a multicycle tool 210, a completion test tool 212, an isolation valve 214 and an inflatable packer, the valve 214 and packer 216 being coupled to the tool 210 by respective control lines 215, 217 216.

Before describing the elements of the apparatus 200 and their operation in detail, the mode of use of the apparatus 202 will be briefly described.

Figure 9A:
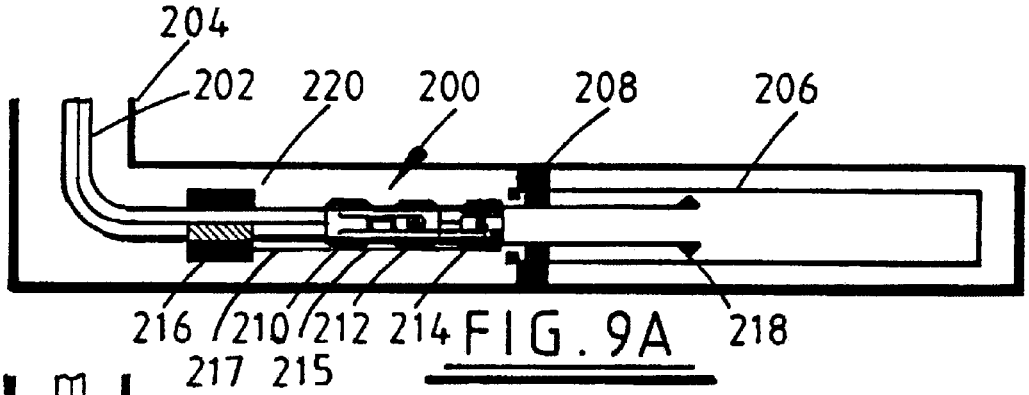
FIGS. 9A–9D are somewhat schematic illustrations of apparatus in accordance with a preferred embodiment of the present invention.

As the string 202 is made up and lowered into the borehole, with the apparatus 200 on the lower end thereof, the isolation valve 214 is locked shut while the completion test tool is normally open, allowing well fluid to fill the string 202. Tubular or sections are added to the string 202 at the surface until a collet 218 provided on the lower end of the string 202 engages the liner top, thus providing an indication at the surface of length of string necessary to properly locate the end of the string in the liner 206. The tubing string 202 may then be retracted somewhat to cushion as required (FIG. 9A).

Figure 9B:
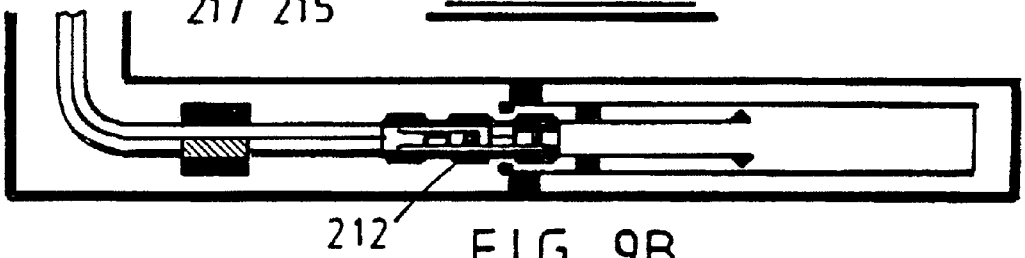
Figure 9C:
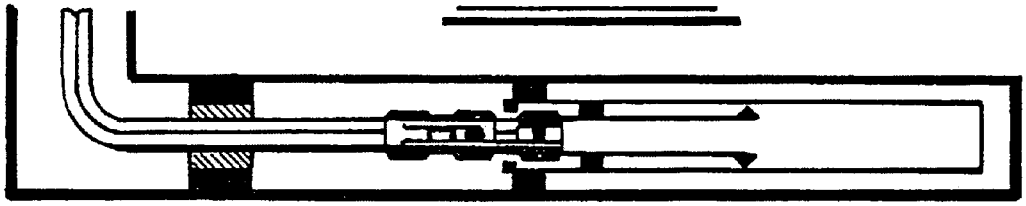
Figure 9D:
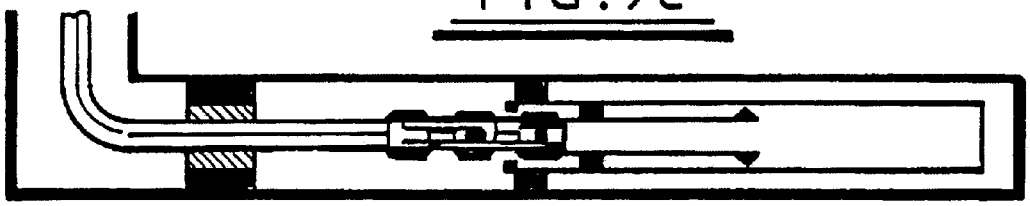

The completion test tool 212 is then closed or locked out by pumping well fluid into the string 202 above a predetermined rate, as disclosed in the above-mentioned UK Patent Application. As will be described, the multicycle tool 210 operates in conjunction with the completion test tool 212 to lock the tool 212 in its closed configuration (FIG. 9B).

The string is then spaced out and the tubing hanger and downhole safety valve (not shown) are pressure tested. After a number of additional pressure cycles are applied to the string 202 to cycle the tool 210 to allow for equipment or testing problems the packer 216 is set using pressurised well fluid from the string bore. Application of a further pressure cycle operates the tool 210 to allow opening of the isolation valve 214.

Figure 10:
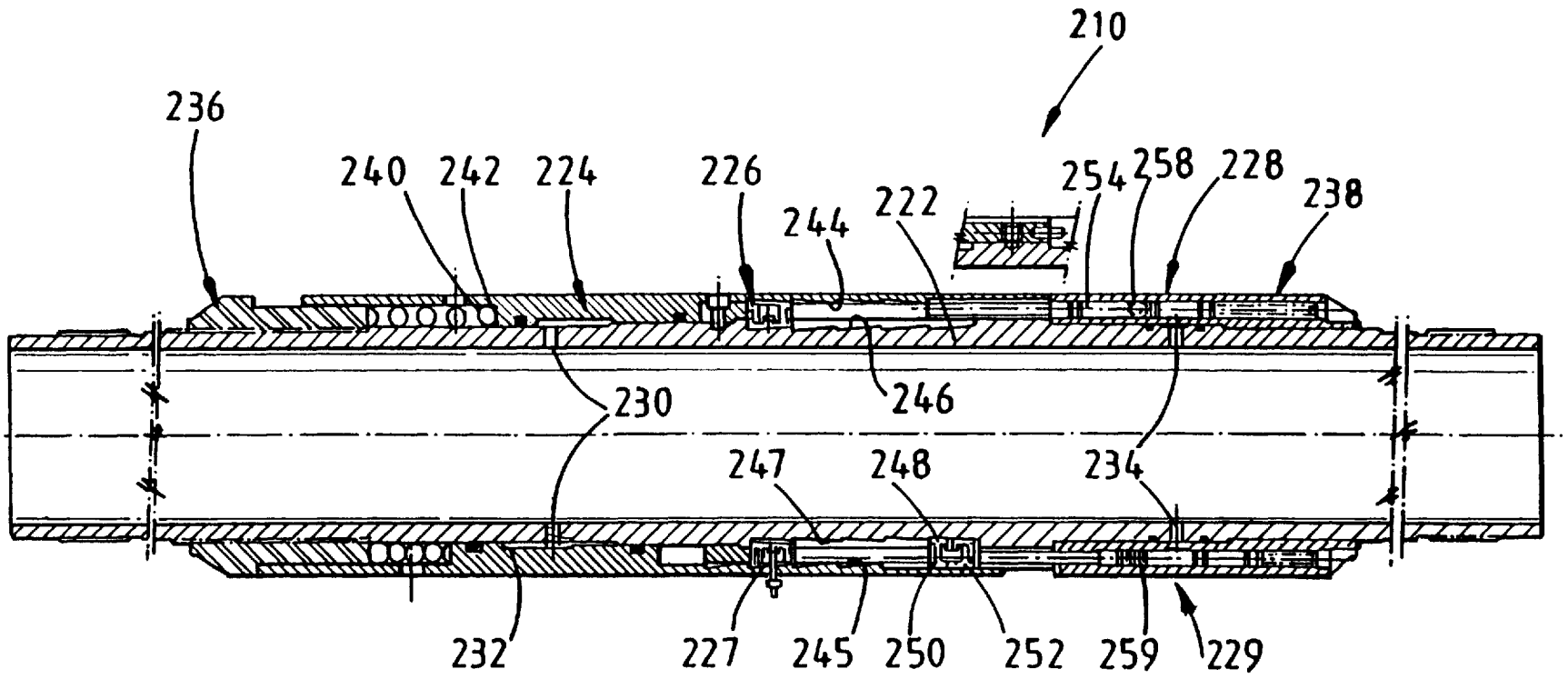
FIG. 10 is a sectional view of a multicycle tool of the apparatus of FIG. 9.

Reference is now also made to FIG. 10 of the drawings, which is a sectional view of the multicycle tool 210. The upper half of the drawing shows the tool in a first configuration and the lower half of the drawing shows the tool in a second configuration, when hydraulic fluid pressure above a predetermined level is being applied to the string bore.

The tool 210 comprises a tubular body 222 and a sleeve 224 mounted on the body 222 and being movable in a reciprocal manner relative thereto by cyclic application of fluid pressure, as will be described. Four actuators (only two shown) including actuator members in the form of ratches 226, 227 are provided for opening valves on the upper end of the body 222, in this particular embodiment the actuator serving to open respective shuttle valves 228, 229, as will be described.

The body 222 defines two series of fluid ports, the first ports 230 for communicating with a piston area 232 defined by a shoulder on the sleeve 224, and the second set of ports 234 for communicating with the respective valves 228, 229.

The sleeve 224 is retained on the body 222 between an end cap 236 and an end sleeve 238 which accommodates the valves 228, 229. The sleeve 224 is normally biased upwardly by a compression spring 240 acting between the end cap 236 and a shoulder 242 defined by the sleeve 224.

The upper end of the sleeve 224 defines four axially extending ratchet tracks 244, 245 (only two shown) located adjacent respective ratchet tracks 246, 247 defined on the outer surface of the body 222. The ratches 226, 227 are located between the respective tracks 244–247.

Application of fluid pressure above a predetermined level to the bore of the body 222 creates sufficient force on the piston area 232 to overcome the spring 240 and move the sleeve 224 downwardly relative to the body 222, to the configuration as illustrated in the lower half of FIG. 10. During this movement of the sleeve 224, the ratches 226, 227 are restrained axially relative to the body 222 by the body ratchet tracks 246, 247. The teeth of the sleeve ratchet tracks 244, 245 are spaced apart such that the upwardly adjacent tooth passes under the lower edge of the respective ratches 226, 227, such that when pressure is bled off from the string bore the ratches 226, 227 will move upwardly with the sleeve 224, as the sleeve 224 is returned to its initial position under the action of the spring 240.

Each ratch comprises an inner part 248 for engaging the sleeve ratchet tracks 244, 245 and an outer part 250 for engaging the body ratchet tracks 245, 246. A compression spring 252 between the parts 248, 250 pushes the parts radially apart and into contact with the respective tracks. The assemblies 226, 227 are generally trapezoidal in section.

Figure 11:
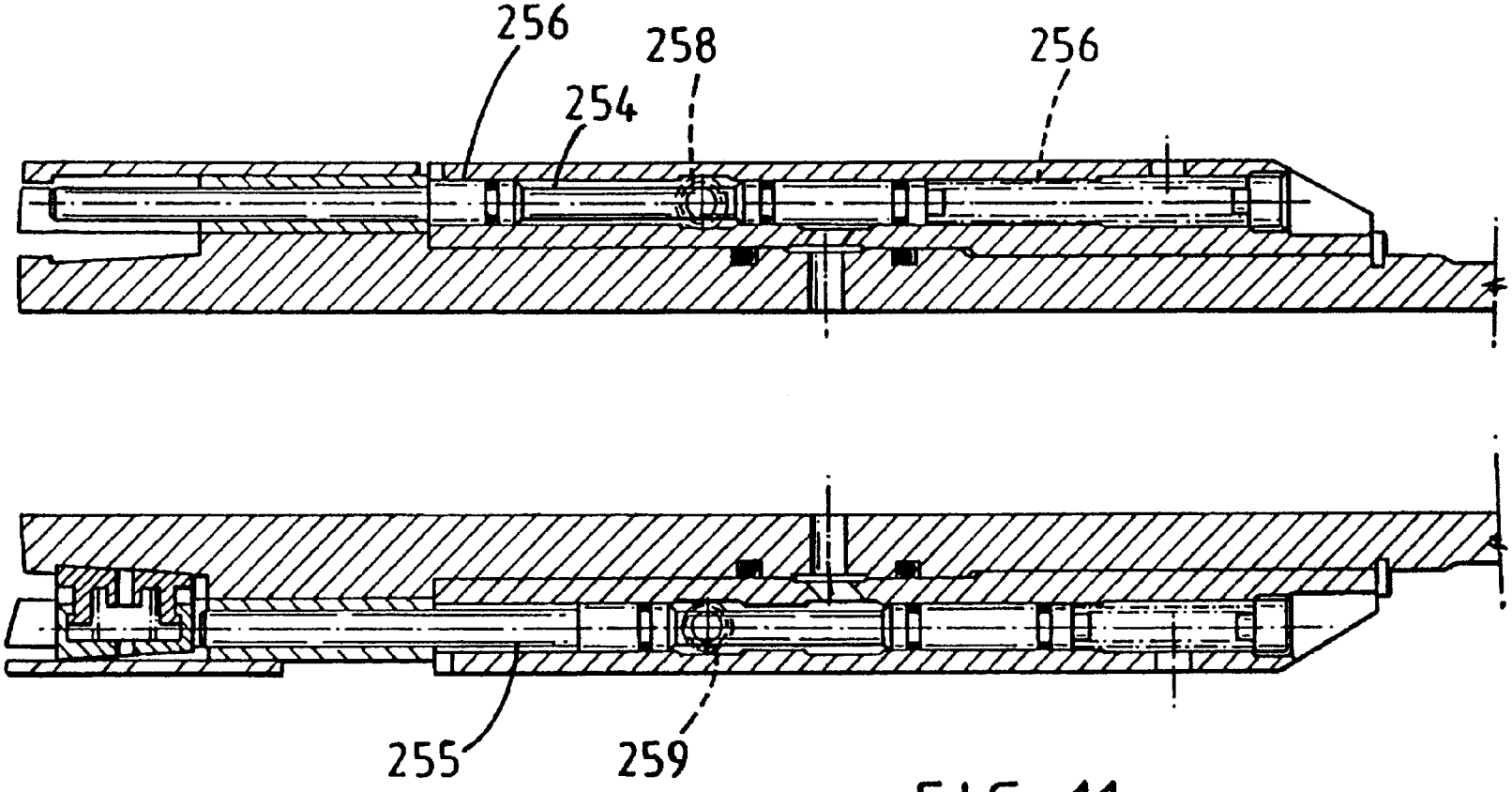
FIG. 11 is an enlarged sectional view of valves provided in the tool of FIG. 10.

It will be noted that each pressure cycle will advance the respective ratch 226, 227 one step up the respective body ratchet track 246, 247. When moving onto the uppermost step of the tracks 246, 247, the assembly 226, 227 engages the lower end of a valve shuttle 254, 255. Details of the shuttles 254, 255, and the shuttle valves 228, 229, may be seen in FIG. 11 of the drawings, the upper half of the drawings showing the shuttle 254 in the closed position, and the lower half of the drawing showing the shuttle 255 in the open position. Each shuttle 254, 255 is biased towards the closed position by a respective compression spring 256 and controls fluid communication between the respective body ports 234 and ports 258, 259 leading to respective control lines in communication with the completion test tool 212, isolation valve 214 and packer 216.

The number of pressure cycles necessary to open a respective shuttle valve 228, 229, and thus permit pressure actuation of the respective tool 212, 214, 216, is determined by the initial positioning of the respective ratches 226, 227 on the ratchet tracks 244–247; four pressure cycles will be necessary to bring the ratch 226 illustrated in FIG. 10 into contact with the shuttle 254, whereas if the ratchet assembly 226 had initially been located further up the ratchet tracks fewer pressure cycles would have been required.

As noted above, the completion test tool 212 provided in conjunction with the multicycle tool 210 is similar to that described in GB-A-2272774, with the addition of a locking sleeve which may be moved into a position to lock the tool closed. The locking sleeve is moved into the locking position by application of fluid pressure to the tubing bore, and is moved into locking position after a predetermined number of pressure cycles under the control of the multicycle tool 210.

Further pressure cycles will cause a second ratch to move a respective shuttle to the open position, allowing inflation of the packer 216 via the multicycle tool 210.

Further pressure cycles will then cause a third ratch to move a respective shuttle to the open position, allowing opening of the isolation valve 214 by application of well fluid pressure.

Reference is now made to FIGS. 12, 13, 14 and 15 of the drawings, which illustrate a portion of a tool 310 in accordance with a further embodiment of the present invention. The tool 310 comprises a first part in the form of a tubular body 322 and a second part in the form of a sleeve 324 being mounted on the body 322 and being movable in a reciprocal manner relative thereto by cyclic application of fluid pressure, in a similar manner to the embodiments described above. Further, the tool 310 includes an actuator of similar form to the actuator of the tool 210, including an actuator member in the form of a ratch 326 which is advanced along a ratchet track by movement of the sleeve 324 relative to the body 322.

The tool 310 acts as a completion test tool in a similar manner to the tools described above: in an initial normal position the body 322 and sleeve 324 define aligned bores (not shown) which permit fluid communication between the body bore and the annulus. However, by increasing the fluid pressure in the body bore the sleeve 324 may be moved relative to the body 322, to close the body port.

The ratch 326 engages an end of a sleeve 325 which forms a valve member. The sleeve 325 defines a port 327 which may be aligned with a port 334 in the body 322 to provide communication with a bore 335 formed on an outer portion of the body 337 and which communicates with a fluid passage connectable to a control line extending to a packer.

Figures 12, 13, 13A, 14, 15:
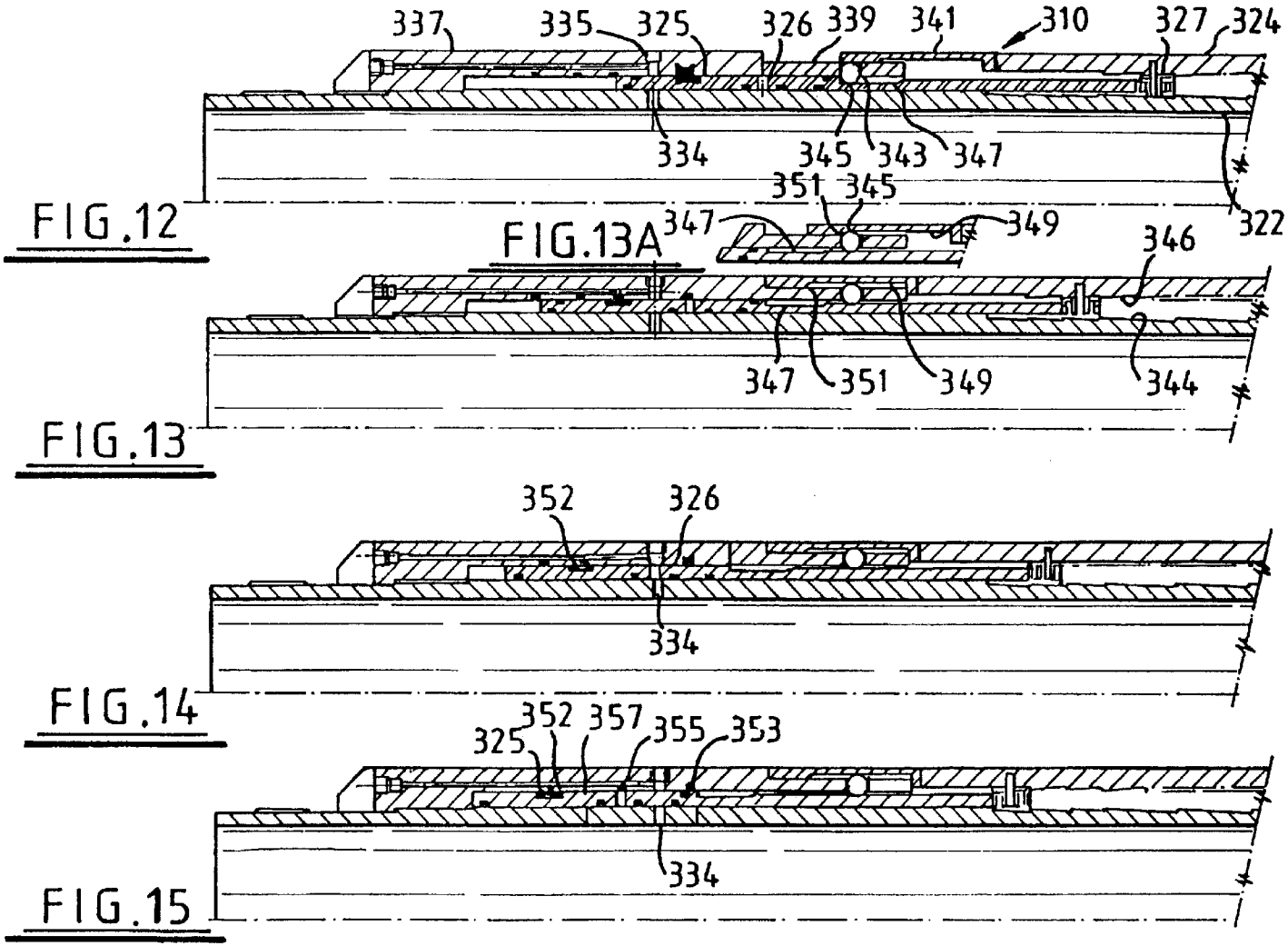
FIGS. 12, 13, 14 and 15 are half sectional views of a portion of a multicycle tool in accordance with a further embodiment of the present invention.

A feature of the tool 310 is that the return movement of the sleeve 324 relative to the body 322 is restricted such that after a predetermined number of pressure cycles the sleeve 324 will be restrained relative to the body 322 such that the ports for providing fluid communication between the body bore and the annulus do not come into alignment. The outer body portion 337 defines a male part 339 which is received by a female part 341 of the sleeve 324 as the sleeve 324 moves upwardly relatively to the body 322. The male part 339 defines an aperture 343 locating a key in the form of a ball 345. The initial normal relative positions of the body 322 and the sleeve 324 are illustrated in FIG. 12, from which it will be noted that the ball 345 has been deflected radially inwardly, by contact with the inner wall of the female part 341, into an annular recess 347 defined in the outer wall of the sleeve 325. On the pressure within the body bore being increased, the sleeve 324 moves upwardly, carrying the ratch 326, such that the sleeve 325 advances along the body 322. With the sleeve 325 positioned relative to the body 322 as illustrated in FIG. 12, on bleeding-off the pressure from the body bore the female part 341 of the sleeve is free to move over the male part 339 of the body 322. However, as the valve sleeve 325 is moved upwardly relative to the body 322 in a subsequent pressure cycle, the ball 345 is moved radially outwardly from the recess 347 and extends into a recessed portion 349 of the sleeve 324. When pressure is then bled-off from the body bore, the sleeve 324 moves downwardly only until a shoulder 351 defined at the upper end of the recess portion 349 contacts the ball 345 (FIG. 13A). As the ball 345 is no longer free to move radially inwardly further movement of the sleeve 324 is prevented, and thus the apertures in the body 322 and sleeve 324 remain out of alignment.

In subsequent pressure cycling, the sleeve 324 will of course only move a restricted distance relative to the body 322, and this is accommodated by the provision of smaller teeth on the ratchet tracks 344, 346.

It will also be noted that, in this embodiment, continued pressure cycling will align the ports 327, 334 allowing fluid communication with the packer (FIG. 14), and a further cycle will move the valve sleeve 325 to seal the port 334 (FIG. 15).

This embodiment of the invention features a further feature not present in the other embodiments, which allows the position of the valve sleeve 325 to be monitored from the surface. This is useful in that it provides an indication of, for example, the number of cycles that are available before the sleeve 324 is restrained by the ball 345 contacting the shoulder 351, or the number of cycles before the packer is set. The valve sleeve 325 is provided with a copper insert 352 which, as it is moved up the body 322, contacts small transmitters 353, 355, 357 provided in the body, and triggers the transmitters to produce a signal at a predetermined frequency. The signals are detected and displayed at the surface using a suitable receiver and display apparatus, and thus provide the operator with an indication of the position of the valve sleeve 325. This feature is useful as movement of the string in the bore during make-up may inadvertently result in movement of the actuator sleeve 324 and advance the ratch 326 along the track 346; if the operator is unaware of this it is possible that, for example, the packer would be actuated prematurely.

Figure 16:
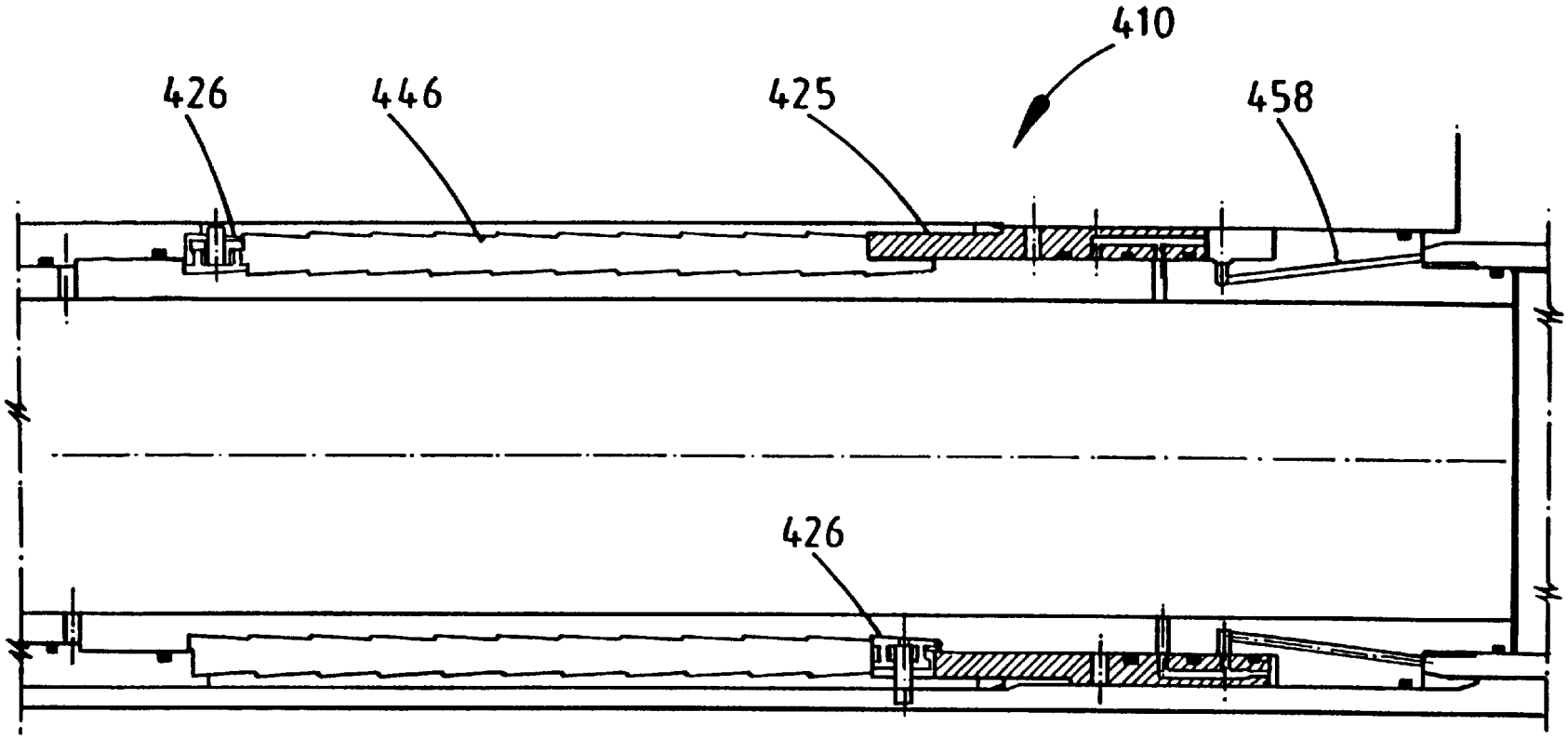
FIG. 16 is a sectional view of a portion of a tool in accordance with another embodiment of the present invention.

Reference is now made to FIG. 16 of the drawings, which illustrates a portion of the tool 410 in accordance with another embodiment of present invention. In the previously described embodiments, the tools were arranged to provide selective fluid communication with further tools on the string. However, the tool 410 includes a valve arrangement for controlling the supply of pressurised bore fluid to a single fluid actuated device forming part of the same tool. The tool 410 includes a ratch 426 which may be advanced along a ratchet track 446 on the tool body 422 from an initial position (see upper half of figure) to open a valve (see lower half of figure) including a sleeve 425 defining a passage for providing fluid communication between the body bore and a passage 458 leading to the fluid actuated device.

It will be noted from the above described embodiments that the apparatuses provide a convenient arrangement for sequentially testing the completion of a string, and then actuating or setting a variety of tools and devices, including packers, full flow sleeves and isolation valves, merely by cycling the pressure of fluid in the string bore. It will be clear to those of skill in the art that the apparatus may be utilised in combination with a range of other tools.

What is claimed is:

1. Downhole completion apparatus for mounting on a string below a packer in combination with a fluid pressure actuated device, the apparatus comprising:

a tubular body defining a bore;

means for sealing the body bore;

a valve for controlling the flow of well fluid through a first port in the tubular body, the port being in communication with said fluid pressure actuated device; and a valve actuator mounted on the body and movable relative thereto, to open the valve, on application of well fluid pressure to the body bore above the sealing means, to permit actuation of said fluid pressure actuated device.

2. The apparatus of claim 1 wherein the actuator includes an axially slidable sleeve, the sleeve being a valve member and defining a circulating port for selectively providing fluid communication with a further port in the body, to permit fluid circulation between the bore and an annulus defined between the body and a surrounding bore wall.

3. The apparatus of claim 1 in which the fluid actuated device is a packer.

4. The apparatus of claim 2 wherein the sleeve is biased towards a first position by a spring.

5. The apparatus of claim 2 wherein the sleeve defines a piston in fluid communication with the body bore, whereby an increase in the bore pressure is communicated to the piston and tends to move the piston towards a second position.

6. The apparatus of claim 2 wherein the actuator sleeve is initially positioned on the body to permit circulation through said further body port, application of fluid pressure moving the sleeve to a second position to close the port, and means being provided for biasing the sleeve to return to the initial position.

7. The apparatus of claim 1 including two or more valves for selectively controlling well fluid communication to a plurality of fluid actuated devices.

8. The apparatus of claim 1 in combination with one of a flow sleeve and an isolation valve.

9. Downhole apparatus for location in a drilled bore, the apparatus comprising:

a tubular body defining a bore;

a fluid pressure actuated device mounted on the body;

a valve for controlling flow of well fluid through a first port in the tubular body to control actuation of the fluid pressure actuated device; and a valve actuator mounted on the body and movable relative thereto to open the valve on application of well fluid pressure, the valve actuator including an axially slidable sleeve defining a circulating port for selectively providing fluid communication with a further port in the body, to permit passage of fluid between the body bore and an annulus defined between the body and the wall of the drilled bore.

10. Downhole completion apparatus for mounting on a string below a packer, the apparatus comprising:

a tubular body defining a bore;

means for sealing the body bore;

a valve for controlling the flow of well fluid through a first port in the tubular body, the port being in communication with a fluid pressure actuated device; and a valve actuator mounted on the body and movable relative thereto, to open the valve, on application of well fluid pressure to the body bore above the sealing means, the actuator including an axially slidable sleeve, the sleeve being a valve member and defining a circulating port for selectively providing fluid communication with a further port in the body, to permit fluid circulation between the bore and an annulus defined between the body and a surrounding bore wall, the actuator sleeve being initially positioned on the body to permit circulation through said further body port, application of fluid pressure moving the sleeve to a second position to close the port, and means being provided for biasing the sleeve to return to the initial position, wherein means is provided for restricting return movement of the sleeve from the second position such that the further body port remains closed after a predetermined number of pressure cycles.

11. Downhole apparatus for location in a drilled bore, the apparatus comprising:

a tubular body defining a bore;

a fluid pressure actuated device mounted on the body;

a valve for controlling flow of well fluid through a first port in the tubular body to control actuation of the fluid pressure actuated device, the actuator including an axially slidable sleeve, the sleeve being a valve member and defining a circulating port for selectively providing fluid communication with a further port in the body, to permit fluid circulation between the bore and an annulus defined between the body and a surrounding bore wall, wherein the actuator includes a ratchet assembly having a ratch member which advances one step relative to the body towards an actuating position with each pressure cycle.

12. The apparatus of claim 11 wherein the ratchet assembly is provided between the body and the sleeve and the ratch member is advanced axially along the body.

13. The apparatus of claim 12 wherein the ratch member is located between ratchet tracks defined by the sleeve and body.

14. Downhole completion apparatus for mounting on a string below a packer, the apparatus comprising:

a tubular body defining a bore;

means for sealing the body bore;

a valve for controlling the flow of well fluid through a first port in the tubular body, the port being in communication with a fluid pressure actuated device; and a valve actuator mounted on the body and movable relative thereto, to open the valve, on application of well fluid pressure to the body bore above the sealing means, wherein the valve is in the form of a shuttle valve.

15. A method of selectively actuating a pressure actuated downhole device mounted on a tubular body defining a bore and mounted on a string below a packer, the method comprising:

sealing the body bore below the packer;

providing a valve for controlling flow of well fluid through a port in the tubular body, the port being in communication with a fluid pressure actuated device;

providing a valve actuator on the tubular body; and applying well fluid pressure to the body bore to move the actuator to open the valve and permit communication of said fluid pressure to said device to actuate said device.

16. The method of claim 15 wherein the pressure actuated device is the packer and the packer communicates with the port via a control line.

17. The method of claim 16 wherein the valve is located below the packer.

18. A method of (i) selectively actuating a pressure actuated downhole device mounted on a tubular body defining a bore and (ii) permitting fluid circulation between the body bore and an annulus defined between the body and the wall of a drilled bore, the method comprising:

providing a valve for controlling flow of well fluid through a port in the tubular body, the port being in communication with a fluid pressure actuated device;

providing a valve actuator on the tubular body, the valve actuator including an axially slidable sleeve defining a circulating port for selectively providing fluid communication with a further port in the body;

(i) applying well fluid pressure to the actuator to open said valve and actuate said device; and (ii) applying well fluid pressure to the actuator to move the sleeve and permit fluid circulation between the body bore and an annulus defined between the body and the wall of the drilled bore via said circulating port and said further port in the body.

* * * * *